US009459013B2

(12) United States Patent
Yamashita et al.

(10) Patent No.: US 9,459,013 B2
(45) Date of Patent: Oct. 4, 2016

(54) AIR-CONDITIONING APPARATUS WITH SAFETY MEASURE FOR VENTILATION OF INFLAMMABLE REFRIGERANT FROM HEAT EXCHANGER

(75) Inventors: Koji Yamashita, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 309 days.

(21) Appl. No.: 13/878,262

(22) PCT Filed: Dec. 3, 2010

(86) PCT No.: PCT/JP2010/007048

§ 371 (c)(1),
(2), (4) Date: Apr. 8, 2013

(87) PCT Pub. No.: WO2012/073293

PCT Pub. Date: Jun. 7, 2012

(65) Prior Publication Data

US 2013/0192283 A1 Aug. 1, 2013

(51) Int. Cl.
*F25B 49/00* (2006.01)
*F24F 1/32* (2011.01)
(Continued)

(52) U.S. Cl.
CPC ..... *F24F 1/32* (2013.01); *F24F 3/065* (2013.01); *F24F 3/08* (2013.01); *F24F 11/04* (2013.01); *F24F 13/20* (2013.01); *F25B 13/00* (2013.01);
(Continued)

(58) Field of Classification Search
CPC ..... F24F 1/32; F24F 1/56; F24F 3/08; F24F 13/20; F25B 49/005
See application file for complete search history.

(56) References Cited

U.S. PATENT DOCUMENTS 8,515,584 B2 * 8/2013 Miller ..... G05B 19/042 236/44 C
2006/0199518 A1 * 9/2006 Spiegel ..... A61G 10/023 454/238

(Continued)

FOREIGN PATENT DOCUMENTS

EP 0936417 * 8/1999 ..... F24F 11/00
JP 2000-006801 A 1/2000

(Continued)

OTHER PUBLICATIONS

Machine Translation for JP 2002115939.*

(Continued)

*Primary Examiner* — Ryan J Walters
*Assistant Examiner* — Antonio R Febles
(74) *Attorney, Agent, or Firm* — Posz Law Group, PLC

(57) ABSTRACT

A refrigerant circuit device includes a compressor, a heat exchanger that is capable of exchanging heat between the refrigerant and a heat medium, and other components that are connected by pipes, in which the refrigerant circuit circulates a refrigerant. A heat medium circulating circuit circulates the heat medium in the heat exchanger. At least the compressor is housed in an outdoor unit, at least the heat exchanger is housed in a heat medium relay unit, and an indoor unit is housed in a use side heat exchanger. The outdoor unit, the heat medium relay unit, and the indoor unit are formed separately and can be disposed in separate positions. A housing of the heat medium relay unit has an opening that allows ventilation between the housing space of the heat exchanger related to heat medium and the space outside the housing space.

17 Claims, 4 Drawing Sheets

(51) Int. Cl.

| | |
|---|---|
| ***F24F 3/06*** | (2006.01) |
| ***F24F 3/08*** | (2006.01) |
| ***F25B 49/02*** | (2006.01) |
| ***F24F 13/20*** | (2006.01) |
| ***F25B 25/00*** | (2006.01) |
| ***F24F 11/04*** | (2006.01) |
| ***F25B 13/00*** | (2006.01) |
| *F24F 11/00* | (2006.01) |

(52) U.S. Cl.

CPC ..... *F25B 25/005* (2013.01); *F25B 49/005* (2013.01); *F25B 49/022* (2013.01); *F24F 2011/0084* (2013.01); *F25B 2313/0233* (2013.01); *F25B 2313/02743* (2013.01); *F25B 2500/222* (2013.01)

(56) References Cited

U.S. PATENT DOCUMENTS

| | | | | |
|---|---|---|---|---|
| 2008/0060367 | A1* | 3/2008 | Zima et al. | 62/149 |
| 2008/0179199 | A1* | 7/2008 | Coignet et al. | 205/793 |
| 2009/0186569 | A1* | 7/2009 | Miura | 454/66 |
| 2010/0193156 | A1* | 8/2010 | Nakatani et al. | 165/63 |

FOREIGN PATENT DOCUMENTS

| | | | | | |
|---|---|---|---|---|---|
| JP | 2001-241697 | A | | 9/2001 | |
| JP | 2001-317884 | A | | 11/2001 | |
| JP | 2001317884 | | * | 11/2001 | F28D 1/06 |
| JP | 2002-115939 | A | | 4/2002 | |
| JP | 2003227664 | A | * | 8/2003 | F25B 45/00 |
| JP | 2003-343936 | A | | 12/2003 | |
| JP | 2004-340568 | A | | 12/2004 | |
| JP | 2005-265377 | A | | 9/2005 | |
| JP | 2009-299910 | A | | 12/2009 | |
| WO | 2010/005007 | A1 | | 5/2010 | |
| WO | 2010/049998 | A1 | | 5/2010 | |
| WO | 2010/050006 | A1 | | 5/2010 | |
| WO | WO 2010131335 | A1 | * | 11/2010 | F25B 13/00 |

OTHER PUBLICATIONS

Machine Translation for Ando et al. (JP 2001-317884).*
Machine Translation for Kushima (JP 2202-115939).*
Machine Translation for Kobayashi et al. (EP 0936417).*
Machine Translation for Shimazu et al. (WO 2010/131335).*
Machine Translation for Takechi et al. (JP 2003-227664).*
Extended European Search Report dated Oct. 14, 2014 in the corresponding EP Application No. 10860382.0.
International Search Report of the International Searching Authority mailed Mar. 8, 2011 for the corresponding international application No. PCT/JP2010/007048 (with English translation).
Chinese Office Action issued on Aug. 19, 2015 in the corresponding Chinese Patent application No. 201080070209.5 ( English translation attached).
Office Action issued Feb. 2, 2015 in the corresponding CN Application No. 2010800702095 (with English translation).

* cited by examiner

AIR-CONDITIONING APPARATUS WITH SAFETY MEASURE FOR VENTILATION OF INFLAMMABLE REFRIGERANT FROM HEAT EXCHANGER

CROSS REFERENCE TO RELATED APPLICATION

This application is a U.S. national stage application of PCT/JP2010/007048 filed on Dec. 3, 2010.

TECHNICAL FIELD

The present invention relates to an air-conditioning apparatus that is applied to, for example, a multi-air-conditioning apparatus for a building.

BACKGROUND ART

For example, there is a multi-air-conditioning apparatus for a building that performs air conditioning by exchanging heat between a refrigerant, which circulates between an outdoor unit and a relay unit, and a heat medium such as water, which circulates between the relay unit and indoor units. During the heat exchange, power for conveying the heat medium is reduced so as to save energy (see Patent Literature 1, for example).

Furthermore, there is an air-conditioning apparatus devised with a countermeasure for refrigerant leakage in a case in which hydrocarbon is employed as a refrigerant. In this air-conditioning apparatus, a refrigerant passage is shut-off with a solenoid valve when there is refrigerant leakage (see Patent Literature 2, for example).

Moreover, there is an air-conditioning apparatus that averts explosion in a case of refrigerant leakage when a combustible refrigerant is employed. In this air-conditioning apparatus, a damper for discharging the refrigerant is activated when leakage of the refrigerant is detected by a refrigerant leak sensor disposed inside a housing of an outdoor unit. Further, the air-conditioning apparatus is configured to operate an air-sending device such that air is sent into the housing (see Patent Literature 3, for example).

CITATION LIST

Patent Literature

Patent Literature 1: WO2010049998 (p. 3, FIG. 1, for example)

Patent Literature 2: Japanese Unexamined Patent Application Publication No. 2000-6801 (p. 2, FIG. 1, for example)

Patent Literature 3: Japanese Unexamined Patent Application Publication No. 2002-115939 (p. 5, FIG. 3, for example)

SUMMARY OF INVENTION

Technical Problem

An air-conditioning apparatus, such as a multi-air-conditioning apparatus for a building described in the above-described Patent Literature 1, is configured such that a refrigerant is made to circulate between an outdoor unit and a relay unit, a heat medium such as water is made to circulate between the relay unit and indoor units, and heat is exchanged in the relay unit between the refrigerant and the heat medium such as water. Accordingly, the refrigerant can be prevented from leaking into the indoor side. However, there is a problem in that no countermeasure in particular to prevent leakage into the housing of the outdoor unit and the like, which becomes a problem when the refrigerant is flammable, is taken.

Furthermore, the air-conditioning apparatus described in Patent Literature 2 performs a processing operation of stopping refrigerant leakage such that a passage is shut off with a solenoid valve when there is refrigerant leakage. However, there is no detailed description of the operation in Patent Literature 2. Moreover, the air volume of the air-sending device is not stipulated.

Additionally, the air-conditioning apparatus described in Patent Literature 3 activates the damper for discharging the refrigerant by reverse rotating the air-sending device when leakage of the refrigerant is detected while the unit is in operation. However, the air-sending device cannot be operated while the unit is suspended. Moreover, the air volume of the air-sending device is not stipulated.

The present invention addresses to solve the above problems and to obtain an air-conditioning apparatus that is capable of further increasing safety by preventing increase in refrigerant concentration inside a housing caused by refrigerant leakage inside the housing and increased its safety

Solution to Problem

The air-conditioning apparatus according to the invention includes a refrigeration cycle including a refrigerant circuit for circulating a refrigerant, the refrigerant circuit being constituted by connecting with pipes a compressor that sends out a combustible refrigerant, a refrigerant flow switching device configured to switch circulation paths of the refrigerant, a heat source side heat exchanger configured to exchange heat of the refrigerant, a refrigerant expansion device configured to control a pressure of the refrigerant, and a heat exchanger related to heat medium capable of exchanging heat between the refrigerant and a heat medium that is different from the refrigerant, in which the refrigerant circuit circulates the refrigerant; and a heat medium side device constituted by a heat medium circulating circuit by connecting with pipes a heat medium sending device configured to circulate the heat medium pertaining to heat exchange of the heat exchanger related to heat medium, and a use side heat exchanger exchanging heat between the heat medium and air related to a conditioned space, in which at least the compressor, the refrigerant flow switching device, the heat source side heat exchanger are housed in an outdoor unit, at least the heat exchanger related to heat medium and the refrigerant expansion device are housed in a heat medium relay unit, and the use side heat exchanger is housed in an indoor unit, while each of the outdoor unit, the heat medium relay unit, and the indoor unit is separately formed and are allowed to be disposed at separate positions, and a housing of the heat medium relay unit includes an opening allowing ventilation between a housing space of the heat exchanger related to heat medium and a space other than the housing space; hence, the air-conditioning apparatus is capable of providing safety when there is refrigerant leakage and is capable of improving energy efficiency.

Advantageous Effects of Invention

In the air-conditioning apparatus of the invention, an opening is provided to a heat medium relay unit allowing a refrigerant that has leaked out to be discharged. As such, since refrigerant concentration can be maintained under a predetermined concentration, ignition or the like owing to refrigerant leakage of a combustible refrigerant can be prevented, and a heat medium relay unit and an air-conditioning apparatus with high safety can be obtained. Furthermore, since the length of pipes circulating a heat medium can be shortened compared to that of the air-conditioning apparatus such as a chiller, conveyance power can be smaller. Hence, energy saving can be achieved.

DESCRIPTION OF EMBODIMENT

Embodiment 1

Figure 1:
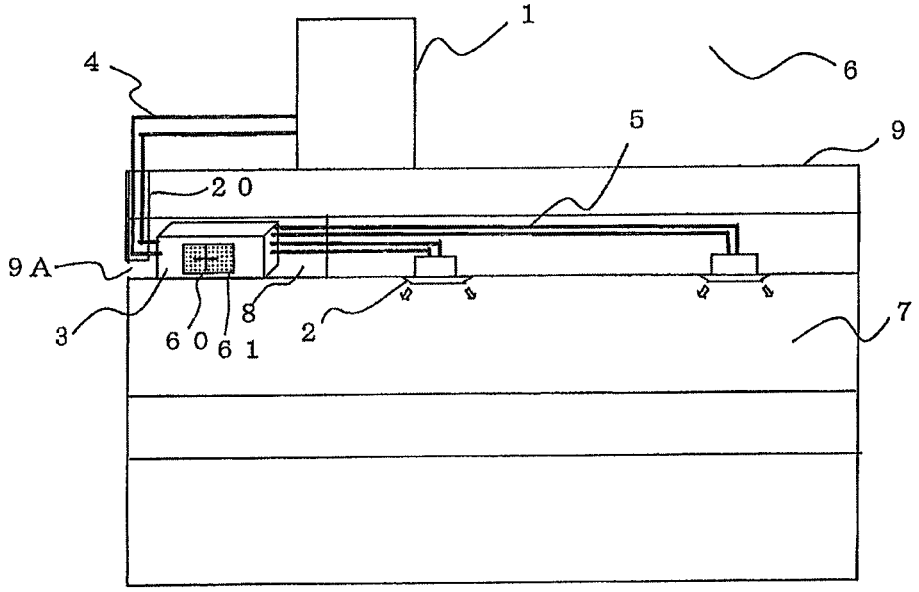
FIG. 1 is a system configuration diagram of an air-conditioning apparatus according to Embodiment 1 of the invention.
Figure 2:
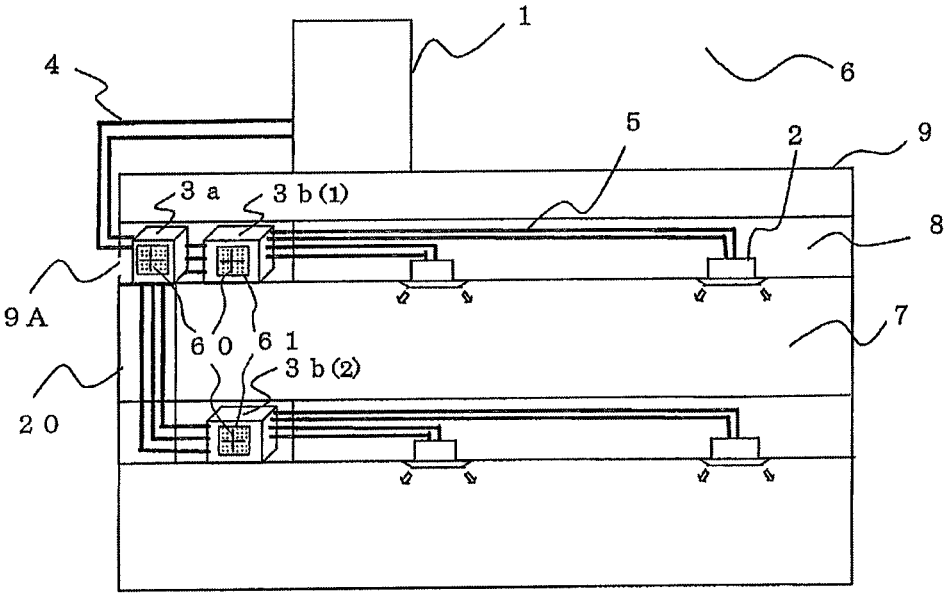
FIG. 2 is another system configuration diagram of the air-conditioning apparatus according to Embodiment 1 of the invention.

An embodiment of the invention will be described with reference to the drawings. FIGS. 1 and 2 are schematic diagrams illustrating exemplary installations of an air-conditioning apparatus according to the embodiment of the invention. The exemplary installations of the air-conditioning apparatus will be described with reference to FIGS. 1 and 2. In this air-conditioning apparatus, an apparatus is used that includes devices and the like that constitute a circuit (a refrigerant circuit (refrigeration cycle circuit) A and a heat medium circulating circuit B) that circulate a flammable heat source side refrigerant (refrigerant) and a heat medium such as water serving as a refrigerant, respectively, such that a cooling mode or a heating mode is allowed to be selected freely as the operation mode in each indoor unit. It should be noted that the dimensional relationships of components in FIG. 1 and other subsequent drawings may be different from the actual ones. Furthermore, like devices that are distinguished by their suffix may omit their suffix when there is no need to particularly distinguish or specify the devices.

Referring to FIG. 1, the air-conditioning apparatus according to the embodiment includes a single outdoor unit 1 functioning as a heat source unit, a plurality of indoor units 2, and a heat medium relay unit 3 disposed between the outdoor unit 1 and the indoor units 2. The heat medium relay unit 3 exchanges heat between the heat source side refrigerant that circulates in the refrigerant circuit and a heat medium that becomes a load (subject of heat exchange) to the heat source side refrigerant. The outdoor unit 1 and the heat medium relay unit 3 are connected with refrigerant pipes 4 through which the heat source side refrigerant flows. The heat medium relay unit 3 and each indoor unit 2 are connected with pipes (heat medium pipes) 5 through which the heat medium flows. Cooling energy or heating energy generated in the outdoor unit 1 is delivered to the indoor units 2 through the heat medium relay unit 3.

Referring to FIG. 2, the air-conditioning apparatus according to the embodiment includes the single outdoor unit 1, the plurality of indoor units 2, a plurality of separated heat medium relay units 3 (a main heat medium relay unit 3*a* and sub heat medium relay units 3*b*) disposed between the outdoor unit 1 and the indoor units 2. The outdoor unit 1 and the main heat medium relay unit 3*a* are connected with the refrigerant pipes 4. The main heat medium relay unit 3*a* and the sub heat medium relay units 3*b* are connected with the refrigerant pipes 4. Each sub heat medium relay unit 3*b* and corresponding indoor units 2 are connected with the pipes 5. Cooling energy or heating energy (quantity of heat) generated in the outdoor unit 1 is delivered to the indoor units 2 through the main heat medium relay unit 3*a* and the sub heat medium relay units 3*b*.

The outdoor unit 1 is typically disposed in an outdoor space 6, which is a space (e.g., a roof) outside a structure 9, such as a building, and is configured to supply cooling energy or heating energy to the indoor units 2 through the heat medium relay unit 3. Each indoor unit 2 is disposed at a position that can supply cooling air or heating air to an indoor space 7, which is a space (e.g., a living room) inside the structure 9, and supplies the cooling air or heating air to the indoor space 7 that is a space to be conditioned. The heat medium relay unit 3 is configured with a housing separate from the outdoor unit 1 and the indoor units 2 such that the heat medium relay unit 3 can be disposed at a position different from those of the outdoor space 6 and the indoor space 7. Furthermore, the heat medium relay unit 3 is connected to the outdoor unit 1 and the indoor units 2 with refrigerant pipes 4 and pipes 5, respectively, to convey heating energy or cooling energy from the outdoor unit 1 to the indoor units 2.

As illustrated in FIGS. 1 and 2, in the air-conditioning apparatus according to the embodiment, the outdoor unit 1 is connected to the heat medium relay unit 3 using two refrigerant pipes 4, and the heat medium relay unit 3 is connected to each indoor unit 2 using two pipes 5. As described above, in the air-conditioning apparatus according to the embodiment, each of the units (the outdoor unit 1, the indoor units 2, and the heat medium relay unit 3) is connected using two pipes (the refrigerant pipes 4 or the pipes 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) derived from the main heat medium relay unit 3*a*. This separation allows a plurality of sub heat medium relay units 3*b* to be connected to the single main heat medium relay unit 3*a*. In this configuration, the number of refrigerant pipes 4 connecting the main heat medium relay unit 3*a* to each sub heat medium relay unit 3*b* is three. Details of this circuit will be described in detail later (see FIG. 3A).

Furthermore, FIGS. 1 and 2 illustrate an exemplary state in which each heat medium relay unit 3 is disposed in the structure 9 but in a space different from the indoor space 7, for example, a space above a ceiling (hereinafter, simply referred to as a "space 8"). Space 8 is not a closed space and is structured to allow ventilation to the outdoor space 6 by means of a vent hole 9A provided in the structure. Note that the vent hole 9A of the structure may be any type of ventilation that is configured to allow ventilation to the outdoor space 6 by natural convection or forced convection when there is leakage of the heat source side refrigerant into the space 8 such that concentration of the heat source side refrigerant in the space 8 does not become excessively high. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out air for heating or air for cooling into the indoor space 7 directly or through a duct or the like.

The air-conditioning apparatus of FIG. 1 and FIG. 2 employs a combustible refrigerant as the heat source side refrigerant that circulates in the refrigerant circuit. As the combustible refrigerant, tetrafluoropropene represented by the chemical formula of $C_3H_2F_4$ (HFO1234yf represented by $CF_3CF{=}CH_2$, HFO1234ze represented by $CF_3CH{=}CHF$, for example) or difluoromethane (R32) represented by the chemical formula of $CH_2F_2$ is employed. Moreover, the combustible refrigerant may be a mixed refrigerant and, in the case of a mixed refrigerant, the refrigerant is, for example, 80% of HFO1234yf and 20% of R32. Furthermore, a highly combustible refrigerant such as R290 (propane) may be employed.

Accordingly, other than the space above a ceiling, the heat medium relay unit 3 may be disposed in any place that is a space other than a living space and that has a ventilation of some kind to the outside. For example, the heat medium relay unit 3 can be disposed in a common space where an elevator or the like is installed, which is a space that has ventilation to the outside.

Although FIGS. 1 and 2 illustrate a case in which the outdoor unit 1 is disposed in the outdoor space 6, the arrangement is not limited to this case. For example, such as a machine room with a ventilation opening, the outdoor unit 1 may be disposed in an enclosed space, or the outdoor unit 1 can be disposed any space where ventilation is provided to the outdoor space 6.

Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to the embodiment is installed.

Further, in order to prevent the heat source side refrigerant from leaking into the indoor space 7 in a case where there is leakage of a heat source side refrigerant from the heat medium relay unit 3, it is desirable to configure the space 8, where the heat medium relay unit 3 is disposed, and the indoor space 7 such that there is no ventilation of air therebetween. However, even if there is a small vent hole between the space 8 and the indoor space 7 such as, for example, a through hole for a pipe, the heat source side refrigerant that has leaked out will be discharged outdoors if the ventilation resistance between the space 8 and the indoor space 7 is set larger than the ventilation resistance of the vent hole between the space 8 and the outdoor space 6; accordingly, there will be no problem.

Furthermore, as illustrated in FIGS. 1 and 2, the refrigerant pipes 4 that connect the outdoor unit 1 and the heat medium relay unit 3 are passed through the outdoor space 6 or through a pipe shaft 20. Since the pipe shaft is a duct for passing the pipes through and its outer surface is surrounded with metal and the like, even if the heat source side refrigerant were to leak out from the refrigerant pipe 4, the heat source side refrigerant will not be diffused to the surroundings. Additionally, since the pipe shaft is disposed in a non-air-conditioned space other than the living space or outdoors, the heat source side refrigerant that has leaked out from the refrigerant pipe 4 is discharged outdoors from the pipe shaft through the non-air-conditioned space 8 or directly from the pipe shaft, and will not leak into the indoor space. Alternatively, the heat medium relay unit 3 may be disposed in the pipe shaft.

Note that in the heat medium relay unit 3, a relay-unit air-sending device 60 is provided that is driven with a predetermined air volume (larger than a ventilation volume) to ventilate air inside the housing.

Now, in the housing of the heat medium relay unit 3, an opening 61 is disposed at a position where air of the relay-unit air-sending device 60 can pass through such that the heat source side refrigerant that has leaked into the housing of the heat medium relay unit 3 is discharged, and thus, no heat source side refrigerant is stagnated inside the housing. In this case, by disposing the relay-unit air-sending device 60 at a position (a position facing the relay-unit air-sending device 60 or in a free space in the panel of the housing, for example) that does not impede the fanned air flow (a position where ventilation resistance is small), it will be possible to discharge the heat source side refrigerant to the outdoor space 6 through the space 8.

Figure 3:
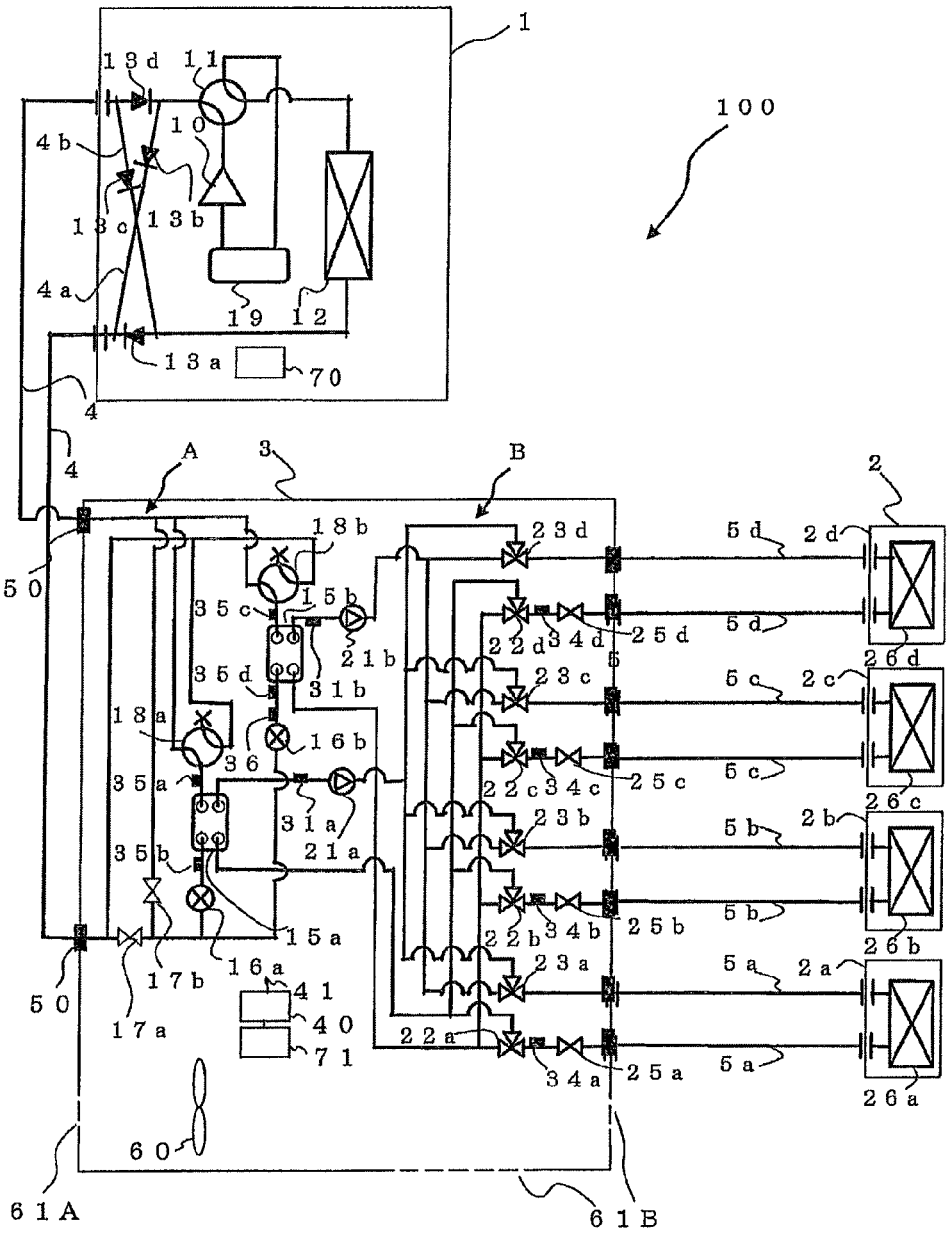
FIG. 3 is a system circuit diagram of the air-conditioning apparatus according to Embodiment 1 of the invention.

The opening 61 includes a first hole 61A and one or more second hole 61B opened at a different position (see FIG. 3). The functions of the relay-unit air-sending device 60, the first hole 61A, and the second hole 61B allows the heat source side refrigerant that has leaked into the housing of the heat medium relay unit 3 to be discharged from the housing, and it is possible to maintain the refrigerant concentration inside the housing under a constant value. Note that if the total opening area of the first hole and the second hole is too small with respect to the size of the housing, the ventilation resistance becomes excessively high and, thus, it will not be possible to obtain sufficient air volume (amount of discharge).

For example, it is empirically known that the housing is sufficiently ventilated therein when the total opening area of the first hole 61A and the second hole 61B is 10% or more of the surface area (including the total opening area) of the housing of the heat medium relay unit 3. Accordingly, when configured as above, it is possible to efficiently discharge the heat source side refrigerant that has leaked into the heat medium relay unit 3 and to maintain the refrigerant concentration under a constant value, and, thus, obtain a safe apparatus. Note that, based on a study on ventilation of buildings, it is known that the resistance coefficient during ventilation does not drop much when the opening ratio of the building is 10% or higher. As such, if the opening ratio of the hole(s) opened in the housing of the heat medium relay unit 3 is equivalent or higher than this, it will be possible to sufficiently ventilate the inside of the housing and, thus, efficiently reduce the refrigerant concentration to a constant value or less.

Furthermore, a hole with a size allowing air sent to the heat medium relay unit 3 from the outside to pass therein, for example, a hole with a size that is 10% or more of the surface area of the housing of the heat medium relay unit may be provided, and an air-sending device may be provided in the space 8. Hereby, air can be made to flow inside the housing of the heat medium relay unit 3 without directly installing an air-sending device to the heat medium relay unit 3.

FIG. 3 is a schematic circuit diagram illustrating an exemplary circuit configuration of the air-conditioning apparatus (hereinafter, referred to as an "air-conditioning apparatus 100") according to Embodiment 1. The detailed configuration of the air-conditioning apparatus 100 will be described with reference to FIG. 3. As illustrated in FIG. 3, the outdoor unit 1 and the heat medium relay unit 3 are connected with the refrigerant pipes 4 through heat exchangers related to heat medium 15*a* and 15*b* included in the heat medium relay unit 3. Furthermore, the heat medium relay unit 3 and the indoor units 2 are connected with the pipes 5 through the heat exchangers related to heat medium 15*a* and 15*b*. Note that the refrigerant pipe 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19, which are connected in series with the refrigerant pipes 4. The outdoor unit 1 is further provided with a first connecting pipe 4*a*, a second connecting pipe 4*b*, a check valve 13*a*, a check valve 13*b*, a check valve 13*c*, and a check valve 13*d*. By providing the first connecting pipe 4*a*, the second connecting pipe 4*b*, the check valve 13*a*, the check valve 13*b*, the check valve 13*c*, and the check valve 13*d*, the heat source side refrigerant can be made to flow into the heat medium relay unit 3 in a constant direction irrespective of the operation requested by the indoor units 2.

The compressor 10 sucks in the heat source side refrigerant and compresses the heat source side refrigerant to a high-temperature high-pressure state. The compressor 10 may include, for example, a capacity-controllable inverter compressor. The first refrigerant flow switching device 11 switches the flow of the heat source side refrigerant between a heating operation (a heating only operation mode and a heating main operation mode) and a cooling operation (a cooling only operation mode and a cooling main operation mode). The heat source side heat exchanger 12 functions as an evaporator during the heating operation and functions as a condenser (or a radiator) during the cooling operation.

During the above, heat is exchanged between air supplied from an outdoor-unit air-sending device (not shown) and the heat source side refrigerant to evaporate and gasify or condense and liquefy the heat source side refrigerant. The accumulator 19 is provided on the suction side of the compressor 10 and retains excess heat source side refrigerant.

The check valve 13*a* is provided in the refrigerant pipe 4 between the heat source side heat exchanger 12 and the heat medium relay unit 3 and permits the heat source side refrigerant to flow only in a predetermined direction (the direction from the outdoor unit 1 to the heat medium relay unit 3). The check valve 13*b* is provided in the first connecting pipe 4*a* and allows the heat source side refrigerant discharged from the compressor 10 to flow through the heat medium relay unit 3 during the heating operation. The check valve 13*c* is disposed in the second connecting pipe 4*b* and allows the heat source side refrigerant, returning from the heat medium relay unit 3, to flow to the suction side of the compressor 10 during the heating operation. The check valve 13*d* is provided in the refrigerant pipe 4 between the heat medium relay unit 3 and the first refrigerant flow switching device 11 and permits the heat source side refrigerant to flow only in a predetermined direction (the direction from the heat medium relay unit 3 to the outdoor unit 1).

In the outdoor unit 1, the first connecting pipe 4*a* connects the refrigerant pipe 4, between the first refrigerant flow switching device 11 and the check valve 13*d*, to the refrigerant pipe 4, between the check valve 13*a* and the heat medium relay unit 3. In the outdoor unit 1, the second connecting pipe 4*b* connects the refrigerant pipe 4, between the check valve 13*d* and the heat medium relay unit 3, to the refrigerant pipe 4, between the heat source side heat exchanger 12 and the check valve 13*a*. It should be noted that although FIG. 3 illustrates a case in which the first connecting pipe 4*a*, the second connecting pipe 4*b*, the check valve 13*a*, the check valve 13*b*, the check valve 13*c*, and the check valve 13*d* are disposed, the outdoor unit is not limited to this case, and they may be omitted.

[Indoor Units 2]

Each of the indoor units 2 includes a use side heat exchanger 26. The use side heat exchanger 26 connects to a heat medium flow control device 25 and a second heat medium flow switching device 23 in the heat medium relay unit 3 with the pipes 5. Each of the use side heat exchangers 26 exchanges heat between air supplied from an air-sending device, such as a fan, (not shown) and the heat medium in order to generate air for heating or air for cooling supplied to the indoor space 7.

FIG. 3 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. Note that the number of connected indoor units 2 is not limited to four that are illustrated in FIG. 3, as well as the examples of FIGS. 1 and 2.

[Heat Medium Relay Unit 3]

The heat medium relay unit 3 includes the two heat exchangers related to heat medium 15, two expansion devices 16, two opening and closing devices 17, two second refrigerant flow switching devices 18, two pumps 21, four first heat medium flow switching devices 22, the four second heat medium flow switching devices 23, and the four heat medium flow control devices 25. An air-conditioning apparatus in which the heat medium relay unit 3 is separated into the main heat medium relay unit 3*a* and the sub heat medium relay unit 3*b* will be described later with reference to FIG. 3A.

Each of the two heat exchangers related to heat medium 15 (the heat exchanger related to heat medium 15*a* and the heat exchanger related to heat medium 15*b*) functions as a condenser (radiator) or an evaporator, exchanges heat, and serves as a load side heat exchanger that transfers cooling energy or heating energy, generated in the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to cool the heat medium in a cooling and heating mixed operation mode. Additionally, the heat exchanger related to heat medium 15*b* is disposed between an expansion device 16*b* and a second refrigerant flow switching device 18*b* in the refrigerant circuit A and is used to heat the heat medium in the cooling and heating mixed operation mode. Although two heat exchangers related to heat medium 15 are disposed herein, one heat exchanger related to heat medium may be disposed or three or more heat exchangers related to heat medium may be disposed.

The two expansion devices 16 (the expansion device 16*a* and the expansion device 16*b*) each have functions of a reducing valve and an expansion valve and are configured to decompress and expand the heat source side refrigerant. The expansion device 16*a* is disposed upstream of the heat exchanger related to heat medium 15*a*, in the heat source side refrigerant flow during the cooling operation. The expansion device 16*b* is disposed upstream of the heat exchanger related to heat medium 15*b*, in the heat source side refrigerant flow during the cooling operation. Each of the two expansion devices 16 may include a component that can variably control its opening degree, such as an electronic expansion valve.

The two opening and closing devices 17 (an opening and closing device 17*a* and an opening and closing device 17*b*) each include, for example, a two-way valve and open and close the refrigerant pipe 4. The opening and closing device 17*a* is disposed in the refrigerant pipe 4 on the inlet side of the heat source side refrigerant. The opening and closing device 17*b* is disposed in a pipe connecting the refrigerant pipe 4 on the inlet side of the heat source side refrigerant and the refrigerant pipe 4 on the outlet side thereof. The two second refrigerant flow switching devices 18 (the second refrigerant flow switching devices 18*a* and 18*b*) each include, for example, a four-way valve and switch the flow of the heat source side refrigerant in accordance with the operation mode. The second refrigerant flow switching device 18*a* is disposed downstream of the heat exchanger related to heat medium 15*a*, in the heat source side refrigerant flow during the cooling operation. The second refrigerant flow switching device 18*b* is disposed downstream of the heat exchanger related to heat medium 15*b*, in the heat source side refrigerant flow during the cooling only operation.

The two pumps 21 (a pump 21*a* and a pump 21*b*) are each provided in accordance with the corresponding one of the heat exchangers related to heat medium 15 and circulate the heat medium flowing through the pipes 5. The pump 21*a* is disposed in the pipe 5 between the heat exchanger related to heat medium 15*a* and the second heat medium flow switching devices 23. The pump 21*b* is disposed in the pipe 5 between the heat exchanger related to heat medium 15*b* and the second heat medium flow switching devices 23. Each of the two pumps 21 may include, for example, a capacity-controllable pump.

The four first heat medium flow switching devices 22 (first heat medium flow switching devices 22*a* to 22*d*) each include, for example, a three-way valve and switches passages of the heat medium. The first heat medium flow switching devices 22 are arranged so that the number thereof (four in this case) corresponds to the installed number of indoor units 2. Each of the first heat medium flow switching devices 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding heat medium flow control device 25. Note that illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 (second heat medium flow switching devices 23*a* to 23*d*) each include, for example, a three-way valve and are configured to switch passages of the heat medium. The second heat medium flow switching devices 23 are arranged so that the number thereof (four in this case) corresponds to the installed number of indoor units 2. Each of the second heat medium flow switching devices 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding use side heat exchanger 26. Note that illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

The four heat medium flow control devices 25 (heat medium flow control devices 25*a* to 25*d*) each include, for example, a two-way valve capable of controlling the area of opening and controls the flow rate of the flow in the corresponding pipe 5. The heat medium flow control devices 25 are arranged so that the number thereof (four in this case) corresponds to the installed number of indoor units 2. Each of the heat medium flow control devices 25 is disposed on the outlet side of the heat medium passage of the corresponding use side heat exchanger 26 such that one way is connected to the use side heat exchanger 26 and the other way is connected to the first heat medium flow switching device 22. Note that illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26.

Furthermore, the heat medium relay unit 3 according to the embodiment includes a refrigerant concentration detection device 40 and shut-off devices 50. The refrigerant concentration detection device 40 includes a refrigerant concentration sensor (concentration detection means) 41, for example. When it is determined that a detection value of the refrigerant concentration detected by the refrigerant concentration sensor 41 is equivalent to or higher than a certain value, an instruction signal is transmitted to the shut-off devices 50 so as to carry out a refrigerant passage closing process. Note that in the embodiment, description is made such that the refrigerant concentration detection device 40 is disposed inside the heat medium relay unit 3; however, for example, the refrigerant concentration detection device 40 may be disposed outside the heat medium relay unit 3 at a position near the heat medium relay unit 3, and the refrigerant concentration inside the housing of the heat medium relay unit 3 may be detected by using a hose or the like. Furthermore, at the refrigerant inlet or outlet of the heat medium relay unit 3, the shut-off devices 50 stop the heat source side refrigerant from flowing in or out by closing the refrigerant passage on the basis of the instruction signal.

Now, a case in which the heat source side refrigerant has leaked into the heat medium relay unit 3 from a joint of pipe in the heat medium relay unit 3, for example, will be discussed. When a combustible refrigerant that is poorly combustible or highly combustible is employed as the heat source side refrigerant that is circulated in the refrigerant circuit, there is a possibility of catching fire, being ignited, or the like (hereinafter, referred to as "ignited or the like") as to the leaked heat source side refrigerant. It is related to the refrigerant concentration in the space whether the combustible refrigerant is ignited or the like. The lower the concentration, the lower the possibility of being ignited or the like, and when lower than a limit, the combustible refrigerant does not become ignited or the like. Herein, the limit concentration ($kg/m^3$) not allowing the combustible refrigerant to be ignited or the like is referred to as an "LFL" (Lower Flammability Limit). For example, even if the heat source side refrigerant were to leak into the housing of the heat medium relay unit 3, if the refrigerant concentration can be suppressed under the "LFL", then, it will not lead to any ignition or the like in the housing and safety can be provided. Now, the "LFL" of each refrigerant is different. For example, the "LFL" of R32 is 0.306 (kg/m$^3$), the "LFL" of HFO1234yf is 0.289 (kg/m$^3$).

Change of concentration in a space when refrigerant is leaking into the space can be computed from the following Equation (1). Note that V is spatial volume (m$^3$), C is refrigerant concentration in the space (kg/m$^3$), Mr is refrigerant leakage rate (kg/s), and Q is ventilation volume (m$^3$/s).

$$V \times dC/dt = Mr - C \times Q \quad (1)$$

Figure 4:
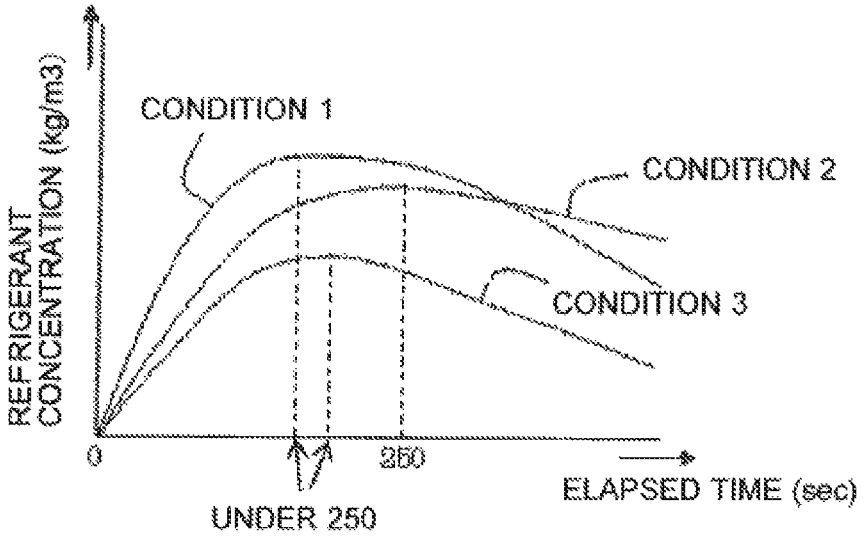
FIG. 4 is an exemplary diagram illustrating results of an experiment on changes in refrigerant concentration in a space.

FIG. 4 is an exemplary diagram illustrating results of an experiment on the changes of refrigerant concentration in a space. When a refrigerant leaks out of a joint of pipe in a space where a constant volume of ventilation is carried out, the refrigerant concentration in the space increases instantaneously from the start of leakage. Next, with the drop of the refrigerant pressure inside the pipe, the refrigerant amount leaking from the pipe decreases and the increase in the refrigerant concentration becomes slow. Then, after the refrigerant concentration exhibits its maximum value, the refrigerant concentration becomes lower when the amount of refrigerant leakage becomes smaller than a ventilation volume Q.

Now, an experiment has been conducted on the change of refrigerant concentration in a case in which a refrigerant is leaked from an air-conditioning apparatus into a space where ventilation is being carried out while conditions such as the amount of charged refrigerant, point of leakage, and the like are changed. As illustrated in FIG. 4, it has been understood from the results that, in a general-purpose air-conditioning apparatus, the time it takes from the start of leakage until the maximum refrigerant concentration is indicated is 250 seconds or less (regardless of the conditions).

In an air-conditioning apparatus including the refrigerant concentration detection device 40 disposed inside the heat medium relay unit 3 and the shut-off devices 50 disposed in each of the refrigerant inlet/outlet of the heat medium relay unit 3, a case will be discussed in which, after the refrigerant concentration detection device 40 detects refrigerant leakage, the refrigerant passage is shut off by closing the shut-off devices 50 when the detection value becomes equivalent to or higher than a predetermined value. Here, when assuming that the refrigerant amount existing in the refrigerant pipe in the heat medium relay unit 3 is 1 (kg), for example, it is suffice to assume that the refrigerant leakage rate Mr is leaking at Mr=0.004 (kg/s) (=1 (kg)/250 (s)). The refrigerant amount existing in the refrigerant pipe in the heat medium relay unit 3 is the maximum refrigerant amount during operation when each of the operation modes under each of the environmental conditions is taken into consideration, or is the refrigerant amount obtained by multiplying the refrigerant density (kg/m$^3$) to the total value (m$^3$) of the internal volumes of the refrigerant pipes and each refrigerant component in the heat medium relay unit 3. Here, for example, when assuming that the refrigerant is a liquid refrigerant, then the refrigerant density will be about 1000 (kg/m$^3$). Accordingly, the largest refrigerant amount existing in the refrigerant pipes in the heat medium relay unit 3 is the refrigerant amount obtained by multiplying 1000 (kg/m$^3$) to the total value (m$^3$) of the internal volumes of the refrigerant pipes and the components, through which the refrigerant passes, in the heat medium relay unit 3. It is possible to obtain a safer air-conditioning apparatus by obtaining the ventilation volume Q from Equation (1) on the basis of the largest refrigerant amount.

The ultimate refrigerant concentration obtained by solving Equation (1) is the same irrespective of the spatial volume V (m$^3$). In a case in which the refrigerant is R32, the refrigerant concentration inside the heat medium relay unit 3 can be suppressed under 0.306 (kg/m$^3$), which is the "LFL" of R32, when the ventilation volume Q of the relay-unit air-sending device 60 is set to 0.01307 (m$^3$/s) or greater, that is 0.784 (m$^3$/min) or greater. Furthermore, in a case in which the refrigerant is HFO1234yf, the refrigerant concentration inside the heat medium relay unit 3 can be suppressed under 0.289 (kg/m$^3$), which is the "LFL" of HFO1234yf, when the ventilation volume Q of the relay-unit air-sending device 60 is set to 0.01384 (m$^3$/s) or greater, that is 0.830 (m$^3$/min) or greater.

Here, the refrigerant leakage rate Mr is proportional to the refrigerant amount m. Accordingly, in a case in which the refrigerant amount existing in the refrigerant pipes of the heat medium relay unit 3 is m (kg), the ventilation volume Q of the relay-unit air-sending device 60 may be set to m times or greater than the value described above in order to suppress the refrigerant concentration inside the housing of the heat medium relay unit 3 under the "LFL". For example, in a case in which R32 is employed as the heat source side refrigerant, the ventilation volume Q of the relay-unit air-sending device 60 is set to 0.784×m (m$^3$/min) or greater. Furthermore, in a case in which HFO1234yf is employed as the heat source side refrigerant, the ventilation volume Q of the relay-unit air-sending device 60 is set to 0.830×m (m$^3$/min) or greater. Suppressing of the refrigerant concentration inside the housing of the heat medium relay unit 3 under the "LFL" corresponding to the refrigerant allows the system to be used safely.

Furthermore, in a case of a mixed refrigerant, calculation is conducted using the composition ratio of each refrigerant. For example, in a case of a mixed refrigerant of HFO1234yf and R32, the ventilation volume Q of the relay-unit air-sending device 60 may be set to (0.784×ratio (%) of R32+0.830×ratio (%) of HFO1234yf)×m (m$^3$/min) or greater. For example, when the mixed refrigerant includes 20% (0.2) of R32 and 80% (0.8) of HFO1234yf, then, the ventilation volume Q is (0.1568+0.664)×m=0.8228×m (m$^3$/min) or greater.

Furthermore, when R411B that has an "LFL" of 0.239 (kg/m$^3$) is employed as the heat source side refrigerant, then, a ventilation volume Q of 1.004×m (m$^3$/min) or greater is needed. Moreover, when R141b that has an "LFL" of 0.43 (kg/m$^3$) is employed, then, a ventilation volume Q of 0.55×m (m$^3$/min) or greater is needed.

From the above, as to each of the heat source side refrigerants used in the air-conditioning apparatus (refrigerant circuit A), the refrigerant concentration inside the housing of the heat medium relay unit 3 can be suppressed under the "LFL" if a relay-unit air-sending device 60 that can achieve these ventilation volume Q is disposed. Hence, a safe system can be configured.

Additionally, in a case in which R290 (propane) that is a highly combustible refrigerant is employed as the heat source side refrigerant, since the "LFL" of R290 is 0.038 (kg/m$^3$), a ventilation volume Q of 6.3×m (m$^3$/min) or greater is needed. Furthermore, in a case in which R1270 (propylene) is employed as the heat source side refrigerant, since the "LFL" of R1270 is 0.043 (kg/m$^3$), a ventilation volume Q of 5.5×m (m$^3$/min) or greater is needed.

Note that in the above description, the amount of refrigerant leaking from the air-conditioning apparatus is reduced to the extent possible by disposing the shut-off devices 50. However, the arrangement is not limited to the above. For example, if the relay-unit air-sending device 60 has the capacity of suppressing the refrigerant concentration inside the housing of the heat medium relay unit 3 under the "LFL", taking into account the total refrigerant amount of the air-conditioning apparatus (refrigerant circuit), then the shut-off devices 50 do not need to be disposed. For example, assuming that the refrigerant amount charged in the overall air-conditioning apparatus is m (kg), when m (kg) is 10 (kg), then, it is only sufficient that the ventilation volume Q of the relay-unit air-sending device 60 is 0.784 (m$^3$/min) or greater in a case in which R32 is employed as the heat source side refrigerant. Furthermore, when HFO1234yf is employed as the heat source side refrigerant, it is only sufficient that the ventilation volume Q is 0.830×m (m$^3$/min) or greater. As above, it is possible to achieve safety of the air-conditioning apparatus even when no shut-off devices 50 are disposed.

Note that the relay-unit air-sending device 60 may be controlled such that an ON/OFF operation of the relay-unit air-sending device 60 is carried out or a rotation speed control of the relay-unit air-sending device 60 is carried out, based on the output of the refrigerant concentration detection device 40.

Moreover, the outdoor fan 60 may be stopped when it is determined that the detection value of the refrigerant concentration has continuously been under a predetermined value for a predetermined time. Alternatively, an increase/decrease control of the air volume may be carried out.

Furthermore, refrigerant leakage may occur while the operation of the air-conditioning apparatus is suspended (while the compressor 1 suspended). Accordingly, the refrigerant concentration detection device 40 performs determination on the basis of the refrigerant concentration while the operation of the air-conditioning apparatus is suspended. That is, even when the compressor 10 is in a suspended state, if the detection value of the refrigerant concentration detection device 40 exceeds a predetermined value, there is refrigerant leakage. In such a case, the relay-unit air-sending device 60 is operated to suppress the refrigerant concentration inside the housing of the heat medium relay unit 3 under the "LFL". As such, it is possible to obtain a safe apparatus. Further, if the refrigerant passage is shut off by the shut-off devices 50, then, a safer apparatus can be obtained. Furthermore, if the refrigerant concentration inside the housing of the heat medium relay unit 3 is suppressed under the "LFL" by driving the relay-unit air-sending device 60 at the ventilation volume or higher at all times (including when the operation of the air-conditioning apparatus is suspended), then, the refrigerant concentration detection device 40 does not need to be provided. Moreover, the relay-unit air-sending device 60 may be driven at the ventilation volume or higher at constant intervals such as every minute.

Additionally, it is preferable that a refrigerant concentration detection device that has a similar function to that of the refrigerant concentration detection device 40 is provided in the space 8 where the heat medium relay unit 3 is disposed and that a second air-sending device for ventilation is provided in a position allowing air to be sent out to the outdoor space 6 from the space 8. Similar to the relay-unit air-sending device 60, by suppressing the refrigerant concentration of the space 8 under the "LFL", it is possible to assure safety of the building 9 that uses the air-conditioning apparatus. Here, similar to the relay-unit air-sending device 60, on the basis of the output of the refrigerant concentration detection device, an ON/OFF operation, a rotation speed control, constant operation, or the like may be carried out.

Furthermore, the heat medium relay unit 3 is provided with various detection devices (two heat medium outflow temperature detection devices 31, four heat medium outlet temperature detection devices 34, four refrigerant inflow/outflow temperature detection devices 35, and a refrigerant pressure detection device 36). Information (temperature information and pressure information) detected by these detection devices is transmitted to, for example, an outdoor unit control device 70 that performs integrated control of the operation of the air-conditioning apparatus 100. The information is used to control the driving frequency of the compressor 10, the rotation speed of the air-sending device (not shown), switching of the first refrigerant flow switching device 11, the driving frequency of the pumps 21, switching of the second refrigerant flow switching devices 18, switching of the heat medium passage, and the like.

Each of the two heat medium outflow temperature detection devices 31 (a heat medium outflow temperature detection device 31*a* and a heat medium outflow temperature detection device 31*b*) detects the temperature of the heat medium that has flowed out of the corresponding heat exchanger related to heat medium 15, namely, the heat medium at an outlet of the corresponding heat exchanger related to heat medium 15 and may include, for example, a thermistor. The heat medium outflow temperature detection device 31*a* is disposed in the pipe 5 on the inlet side of the pump 21*a*. The heat medium outflow temperature detection device 31*b* is disposed in the pipe 5 on the inlet side of the pump 21*b*.

Each of the four heat medium outlet temperature detection devices 34 (heat medium outlet temperature detection devices 34*a* to 34*d*) is disposed between the corresponding first heat medium flow switching device 22 and heat medium flow control device 25 and detects the temperature of the heat medium flowing out of the corresponding use side heat exchanger 26. The heat medium outlet temperature detection device 34 may include, for example, a thermistor. The heat medium outlet temperature detection devices 34 are arranged so that the number thereof (four in this case) corresponds to the installed number of indoor units 2. Note that illustrated from the bottom of the drawing are the heat medium outlet temperature detection device 34*a*, the heat medium outlet temperature detection device 34*b*, the heat medium outlet temperature detection device 34*c*, and the heat medium outlet temperature detection device 34*d* so as to correspond to the respective indoor units 2.

Each of the four refrigerant inflow/outflow temperature detection devices 35 (refrigerant inflow/outflow temperature detection devices 35*a* to 35*d*) is disposed on the inlet side or the outlet side of the heat source side refrigerant of the heat exchanger related to heat medium 15 and detects the temperature of the heat source side refrigerant flowing into the heat exchanger related to heat medium 15 or the temperature of the heat source side refrigerant flowing out of the heat exchanger related to heat medium 15 and may include, for example, a thermistor. The refrigerant inflow/outflow temperature detection device 35*a* is disposed between the heat exchanger related to heat medium 15*a* and the second refrigerant flow switching device 18*a*. The refrigerant inflow/outflow temperature detection device 35*b* is disposed between the heat exchanger related to heat medium 15*a* and the refrigerant expansion device 16*a*. The refrigerant inflow/outflow temperature detection device 35*c* is disposed between the heat exchanger related to heat medium 15*b* and the second refrigerant flow switching device 18*b*. The refrigerant inflow/outflow temperature detection device 35*d* is disposed between the heat exchanger related to heat medium 15*b* and the refrigerant expansion device 16*b*.

The refrigerant pressure detection device (pressure sensor) 36 is disposed between the heat exchanger related to heat medium 15*b* and the refrigerant expansion device 16*b*, similar to the installation position of the refrigerant inflow/outflow temperature detection device 35*d*, and is configured to detect the pressure of the heat source side refrigerant flowing between the heat exchanger related to heat medium 15*b* and the expansion device 16*b*.

Further, the indoor side control device 70 includes, for example, a microcomputer and controls the driving frequency of the compressor 10, switching of the first refrigerant flow switching device 11, driving of the pumps 21, the opening degree of each expansion device 16, opening and closing of each opening and closing device 17, switching of the second refrigerant flow switching devices 18, switching of the first heat medium flow switching devices 22, switching of the second heat medium flow switching devices 23, and the opening degree of each heat medium flow control device 25, on the basis of signals associated to detection by the various detection devices and an instruction from a remote control to carry out the operation. Furthermore, in the present embodiment, a relay unit control device 71 constituted by a microcomputer or the like is also included. The relay unit control device 71 controls the relay-unit air-sending device 60 on the basis of the detection of the refrigerant concentration detection device 40. While the refrigerant concentration detection device 40 and the relay unit control device 71 are provided separately, the controller may carry out the process carried out by the refrigerant concentration detection device 40. Moreover, the indoor side control device 70 and the relay unit control device 71 may be integrated and the indoor side control device 70 may carry out control of the relay-unit air-sending device 60.

The pipes 5 in which the heat medium flows include the pipes connected to the heat exchanger related to heat medium 15*a* and the pipes connected to the heat exchanger related to heat medium 15*b*. The pipes 5 are branched into pipes 5*a* to pipes 5*d* (into four branches in this case) in accordance with the number of indoor units 2 connected to the heat medium relay unit 3. Further, the pipes 5 are connected by the first heat medium flow switching devices 22 and the second heat medium flow switching devices 23. Control of the first heat medium flow switching devices 22 and the second heat medium flow switching devices 23 determines whether the heat medium flowing from the heat exchanger related to heat medium 15*a* is allowed to flow into the use side heat exchanger 26 or whether the heat medium flowing from the heat exchanger related to heat medium 15*b* is allowed to flow into the use side heat exchanger 26. For example, when the heat exchanger related to heat medium 15*a* and the heat exchanger related to heat medium 15*b* are both cooling or heating the heat medium, control is carried out such that each heat medium that has exchanged heat in both the heat exchanger related to heat medium 15*a* and the heat exchanger related to heat medium 15*b* are merged in the second heat medium flow switching devices 23, the resultants are made to flow into the use side heat exchangers 26, thereafter, the heat medium are branched in the first heat medium flow switching devices 22, and are returned to the heat exchanger related to heat medium 15*a* and the heat exchanger related to heat medium 15*b*. Furthermore, when the heat exchanger related to heat medium 15*a* is cooling the heat medium and when the heat exchanger related to heat medium 15*b* is heating the heat medium, control is carried out such that each of the first heat medium flow switching devices 22 and each of the second heat medium flow switching devices 23 is switched so that either the cooled heat medium or the heated heat medium is selected to be made to flow into the respective use side heat exchangers 26.

Now, in the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger related to heat medium 15*a*, the refrigerant expansion devices 16, and the accumulator 19 are connected by the refrigerant pipes 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected by the pipes 5, thus forming the heat medium circulating circuit B. In other words, the plurality of use side heat exchangers 26 are connected in parallel to each of the heat exchangers related to heat medium 15, thus forming the heat medium circulating circuit B into a multiple system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are also connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circulating circuit B.

Figure 3A:
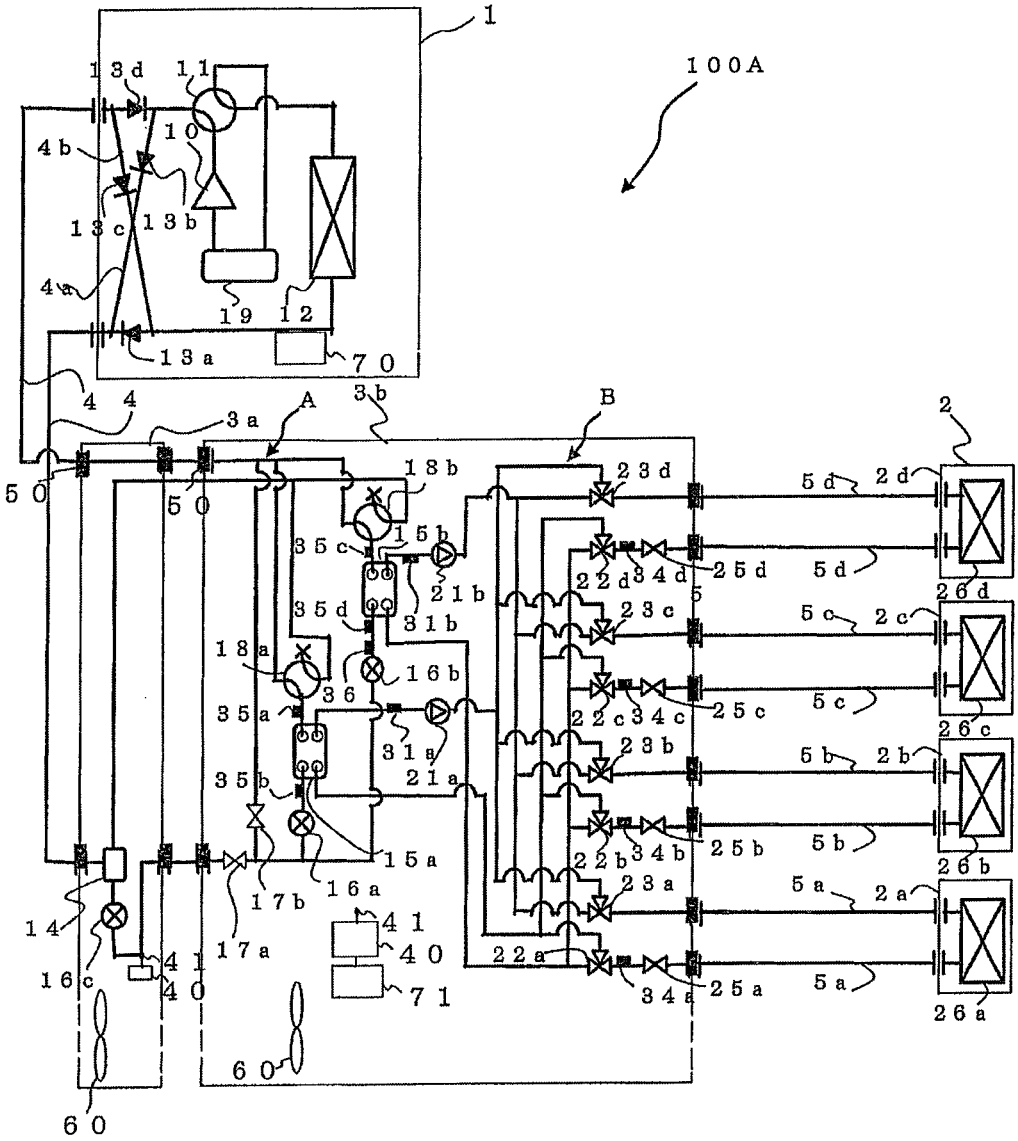
FIG. 3A is another system circuit diagram of the air-conditioning apparatus according to Embodiment 1 of the invention.

FIG. 3A is a schematic circuit diagram illustrating another exemplary circuit configuration of the air-conditioning apparatus (hereinafter, referred to as an "air-conditioning apparatus 100A") according to the embodiment of the invention. The configuration of the air-conditioning apparatus 100A in a case in which the heat medium relay unit 3 is separated into a main heat medium relay unit 3*a* and a sub heat medium relay unit 3*b* will be described with reference to FIG. 3A. As illustrated in FIG. 3A, the housing of the heat medium relay unit 3 is separated such that the heat medium relay unit 3 is composed of the main heat medium relay unit 3*a* and the sub heat medium relay unit 3*b*. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. Other components are arranged in the sub heat medium relay unit 3*b*. The gas-liquid separator 14 is connected to a single refrigerant pipe 4 connected to the outdoor unit 1 and is connected to two refrigerant pipes 4 connected to the heat exchanger related to heat medium 15*a* and the heat exchanger related to heat medium 15*b* in the sub heat medium relay unit 3*b*, and is configured to separate the heat source side refrigerant supplied from the outdoor unit 1 into a vapor refrigerant and a liquid refrigerant. The expansion device 16*c*, disposed on the downstream side regarding the flow direction of the liquid refrigerant flowing out of the gas-liquid separator 14, has functions of a reducing valve and an expansion valve and decompresses and expands the heat source side refrigerant. During the cooling and heating mixed operation, the expansion device 16*c* is controlled such that an outlet thereof is at an intermediate pressure. The expansion device 16*c* may include a component that can variably control its opening degree, such as an electronic expansion valve. This arrangement allows a plurality of sub heat medium relay units 3*b* to be each connected to the main heat medium relay unit 3*a* with three pipes.

[Refrigerant Pipe 4]

The air-conditioning apparatus 100 according to the present embodiment is provided with several operation modes. In these operation modes, the heat source side refrigerant flows through the pipes 4 connecting the outdoor unit 1 and the heat medium relay unit 3.

[Pipe 5]

In the several operation modes carried out by the air-conditioning apparatus 100 according to the embodiment, a heat medium, such as water or antifreeze, flows through the pipes 5 connecting the heat medium relay unit 3 and the indoor units 2.

The operation modes carried out by the air-conditioning apparatus 100 will now be described. The air-conditioning apparatus 100 allows each indoor unit 2 to perform a cooling operation or a heating operation on the basis of a command from the indoor unit 2. That is, the air-conditioning apparatus 100 allows all of the indoor units 2 to perform the same operation and also allows each of the indoor units 2 to perform different operations.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode in which a cooling load is larger, and a heating main operation mode in which a heating load is larger. Note that the air-conditioning apparatus 100A carries out various operation modes similar to those above.

Now, in the air-conditioning apparatus 100, when only the heating load or the cooling load is occurring in the use side heat exchangers 26, the corresponding first heat medium flow switching devices 22 and the corresponding second heat medium flow switching devices 23 are set to a medium opening degree such that the heat medium flows into both of the heat exchanger related to heat medium 15*a* and the heat exchanger related to heat medium 15*b*. Consequently, since both the heat exchanger related to heat medium 15*a* and the heat exchanger related to heat medium 15*b* can be used for the heating operation or the cooling operation, the heat transfer area can be increased, and, accordingly, an efficient heating operation or cooling operation can be performed.

In addition, when the heating load and the cooling load are simultaneously occurring in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 described in the embodiment may be any of the sort as long as they can switch passages, for example, a three-way valve capable of switching between three passages or a combination of two opening and closing valves and the like switching between two passages. Alternatively, components such as a stepper motor driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, in the embodiment, while an exemplary description has been given in which each of the heat medium flow control devices 25 is a two-way valve, each of the heat medium flow control devices 25 may be a control valve having three passages and may be disposed with a bypass pipe that bypasses the corresponding use side heat exchanger 26.

Furthermore, as regards each of the use side heat medium flow control devices 25, a stepping-motor-driven type that is capable of controlling the flow rate in the passage is preferably used. A two-way valve or a three-way valve with a closed end may be used. Alternatively, as regards each of the use side heat medium flow control devices 25, a component, such as an opening and closing valve, which is capable of opening or closing a two-way passage, may be used while ON/OFF operations are repeated to control the average flow rate.

Furthermore, while each second refrigerant flow switching device 18 has been described as if it is a four-way valve, the device is not limited to this type. The device may be configured such that the heat source side refrigerant flows in the same manner using a plurality of two-way flow switching valves or three-way flow switching valves.

While a description has been given that the air-conditioning apparatus 100 according to the present embodiment is capable of performing the cooling and heating mixed operation, the apparatus is not limited to this case. The same advantages can be obtained even in an apparatus that is configured by a single heat exchanger related to heat medium 15 and a single expansion device 16 having a plurality of use side heat exchangers 26 and heat medium flow control valves 25 connected in parallel thereto allowing only a cooling operation or a heating operation to be carried out.

In addition, it is needless to mention that the same holds true for the case in which only a single use side heat exchanger 26 and a single heat medium flow control valve 25 are connected. Moreover, it is needless to mention that no problem will arise even if the heat exchanger related to heat medium 15 and the expansion device 16 acting in the same manner are arranged in plural numbers. Furthermore, while a case has been described in which the heat medium flow control valves 25 are equipped in the heat medium relay unit 3, the arrangement is not limited to this case. Each heat medium flow control valve 25 may be disposed in the indoor unit 2. The heat medium relay unit 3 and the indoor unit 2 may be constituted in different housings.

As regards the heat medium, for example, brine (antifreeze), water, a mixed solution of brine and water, or a mixed solution of water and an additive with high anticorrosive effect can be used. Accordingly, in the air-conditioning apparatus 100, even if the heat medium leaks into the indoor space 7 through the indoor unit 2, because the employed heat medium is highly safe, contribution to improvement of safety can be made.

Further, the heat source side heat exchanger 12 and the use side heat exchangers 26*a* to 26*d* are typically arranged with an air-sending device in which condensing or evaporation is promoted by sending air; however, the heat source side heat exchanger 12 and the use side heat exchangers 26*a* to 26*d* are not limited to the above, a panel heater using radiation can be used as the use side heat exchangers 26*a* to 26*d* and a water-cooled heat exchanger which transfers heat using water or antifreeze can be used as the heat source side heat exchanger 12. Any component structured to radiate or absorb heat may be used.

Furthermore, while an exemplary description with four use side heat exchangers 26*a* to 26*d* has been given, the number is not limited in particular and any number thereof can be connected.

Furthermore, description has been made illustrating a case in which there are two heat exchangers related to heat medium 15, namely, the heat exchanger related to heat mediums 15*a* and 15*b*. As a matter of course, the arrangement is not limited to this case, and any number of heat exchangers related to heat medium may be disposed as long as it is arranged such that cooling and/or heating of the heat medium can be carried out.

Furthermore, each of the number of pumps 21*a* and 21*b* is not limited to one. A plurality of pumps having a small capacity may be used in parallel.

Moreover, the air-sending device disposed in the outdoor unit 1 is not limited to the described system. The same holds true for a direct expansion air conditioner that circulates a refrigerant into the indoor unit and the same advantages can be enjoyed.

As described above, in the air-conditioning apparatus (the air-conditioning apparatus 100 and the air-conditioning apparatus 100A) according to the present embodiment, since the relay-unit air-sending device(s) 60 is driven such that the heat source side refrigerant is discharged at a predetermined ventilation volume, even when a heat source side refrigerant with combustibility leaks into the housing of the heat medium relay unit 3, increase of the refrigerant concentration inside the heat medium relay unit 3 can be prevented, ignition or the like can be prevented, and safety of the outdoor unit 1 and the air-conditioning apparatus can be increased. Here, by setting the ventilation volume in accordance with the "LFL" of the employed refrigerant, ignition or the like can be readily prevented. At this time, with respect to the refrigerant amount m (kg), the ventilation volume of 0.55×m ($m^3$/min) or greater is secured; hence, it is possible to correspond to a variety of refrigerants used in the air-conditioning apparatus. Here, by setting the refrigerant amount on the basis of the internal volume of the refrigerant pipes and devices of the heat medium relay unit 3, it is possible to efficiently set the needed ventilation volume for maintaining safety. Moreover, by assuming the refrigerant density to be 1000 (kg/$m^3$) and by setting the ventilation volume on the basis of the maximum refrigerant amount that can be assumed, ignition or the like can be readily prevented.

Further, since the refrigerant concentration detection device 40 is provided and the relay-unit air-sending device 60 is driven based on the refrigerant concentration according to the detection of the refrigerant concentration sensor 41, it is possible to efficiently drive the relay-unit air-sending device 60 when the refrigerant concentration is equivalent to or higher than a predetermined concentration. Furthermore, since the shut-off devices 50 are provided in each of the refrigerant inlet/outlet of the heat medium relay unit 3 and each of the shut-off devices 50 is made to shut off the flow of the heat source side refrigerant flowing in or out of the heat medium relay unit 3 on the basis of the determination of the refrigerant concentration detection device 40, it is possible to suppress the amount of heat source side refrigerant leakage to only the refrigerant amount confined in the heat medium relay unit 3. Additionally, since the amount of refrigerant leakage is small, the ventilation volume Q of the relay-unit air-sending device 60 can be small.

In addition, by opening the portions of the housing of the heat medium relay unit 3 and forming the first hole 61A and the second hole 61B that serve as the opening 61, the heat source side refrigerant that has leaked into the housing of the heat medium relay unit 3 can be discharged and, thus, it is possible to maintain the refrigerant concentration inside the housing under a constant value. Here, since the opening 61 is opened such that the total opening area of the opening 61 is equivalent to or larger than 10% of the surface area of the housing of the heat medium relay unit 3, the heat source side refrigerant can be efficiently discharged to the outside of the housing of the heat medium relay unit 3 and the refrigerant concentration can be suppressed under a predetermined value without increase in the ventilation resistance. Hence, a safe apparatus can be obtained.

1 heat source unit (outdoor unit); 2, 2*a*, 2*b*, 2*c*, 2*d* indoor unit; 3, 3*a*, 3*b* heat medium relay unit; 4, 4*a*, 4*b* refrigerant pipe; 5, 5*a*, 5*b*, 5*c*, 5*d* pipe; 6 outdoor space; 7 indoor space; 8 space; 9 structure; 9A vent hole; 10 compressor; 11 first refrigerant flow switching device (four-way valve); 12 heat source side heat exchanger; 13*a*, 13*b*, 13*c*, 13*d* check valve; 14 gas-liquid separator; 15*a*, 15*b* heat exchanger related to heat medium; 16*a*, 16*b*, 16*c* expansion device; 17*a*, 17*b* opening and closing device; 18*a*, 18*b* second refrigerant flow switching device; 19 accumulator; 20 refrigerant-refrigerant heat exchanger; 21*a*, 21*b* pump (heat medium sending device); 22*a*, 22*b*, 22*c*, 22*d* first heat medium flow switching device; 23*a*, 23*b*, 23*c*, 23*d* second heat medium flow switching device; 25*a*, 25*b*, 25*c*, 25*d* heat medium flow control device; 26*a*, 26*b*, 26*c*, 26*d* use side heat exchanger; 31*a*, 31*b* heat medium outflow temperature detection device; 34, 34*a*, 34*b*, 34*c*, 34*d* heat medium outlet temperature detection device; 35, 35*a*, 35*b*, 35*c*, 35*d* refrigerant inflow/outflow temperature detection device; 36 refrigerant pressure detection device; 40 refrigerant concentration detection device; 41 refrigerant concentration sensor; 50 shut-off device; 60 outdoor-unit air-sending device; opening; 61A first hole; 61B second hole; 70 outdoor unit control device; 71 relay unit control device; 100, 100A air-conditioning apparatus; A refrigerant circuit; B heat medium circulating circuit.

The invention claimed is:

1. An air-conditioning apparatus, comprising:

a refrigeration cycle including a refrigerant circuit for circulating a refrigerant, the refrigerant circuit being constituted by connecting with pipes a compressor that sends out a combustible refrigerant, a refrigerant flow switching device configured to switch circulation paths of the refrigerant, a heat source side heat exchanger configured to exchange heat of the refrigerant, a refrigerant expansion device configured to control a pressure of the refrigerant, and a plurality of heat exchangers related to heat medium capable of exchanging heat between the refrigerant and a heat medium that is different from the refrigerant; and a heat medium side circuit constituted by a heat medium circulating circuit that is constructed by connecting a plurality of heat medium sending devices configured to circulate the heat medium pertaining to heat exchange of the heat exchangers related to heat medium, and a plurality of use side heat exchangers exchanging heat between the heat medium and air related to a space to be air-conditioned, with pipes, wherein at least the compressor, the refrigerant flow switching device, the heat source side heat exchanger are housed in an outdoor unit, at least the heat exchangers related to heat medium and the refrigerant expansion device are housed in a heat medium relay unit, and the use side heat exchangers are housed in corresponding indoor units, each of the outdoor unit, the heat medium relay unit, and the indoor units being separately formed and being allowed to be disposed at separate positions, a housing of the heat medium relay unit includes an opening allowing ventilation between an inside of the housing and an outside of the housing, and a relay-unit air-sending device that sends air, a controller configured to perform a control operation of the relay-unit air-sending device such that refrigerant concentration inside the housing of the heat medium relay unit is maintained under a predetermined concentration, the controller is configured to set, in the control operation, a ventilation volume of the relay-unit air-sending device to 0.55×m ($m^3$/min) or greater with respect to a refrigerant amount m (kg) in the refrigerant circuit, and the heat medium circulating circuit includes heat medium flow switching devices being connected by pipes to the corresponding use side heat exchangers to perform switching such that the heat medium that passes through each of the heat exchangers related to heat medium is selected and is caused to flow into the use side heat exchangers.

2. The air-conditioning apparatus of claim 1, wherein a total area of the opening is 10% or larger than a surface area of the housing of the heat medium relay unit, the surface area including the total area of the opening.

3. The air-conditioning apparatus of claim 1, wherein the controller operates the relay-unit air-sending device in order to maintain the refrigerant concentration under the predetermined concentration even when the compressor of the outdoor unit is in a suspended state.

4. The air-conditioning apparatus of claim 1, further comprising:

a refrigerant concentration detection device that detects the refrigerant concentration inside the housing, wherein the controller operates the relay-unit air-sending device on a basis of a detection value of the refrigerant concentration detection device.

5. The air-conditioning apparatus of claim 4, further comprising:

shut-off devices that shut off a flow of the refrigerant, the shut-off devices each being disposed in a refrigerant inlet/outlet of the heat medium relay unit, wherein the controller makes the shut-off devices shut off the flow of the refrigerant on a basis of the detection value of the refrigerant concentration detection device.

6. The air-conditioning apparatus of claim 1, wherein the refrigerant is R32 and the ventilation volume of the relay-unit air-sending device is set to 0.784×m ($m^3$/min) or greater.

7. The air-conditioning apparatus of claim 1, wherein the refrigerant is HFO1234yf and a ventilation volume Q of the relay-unit air-sending device is set to 0.830×m ($m^3$/min) or greater.

8. The air-conditioning apparatus of claim 1, wherein the refrigerant is a mixed refrigerant of at least HFO1234yf and R32 and the ventilation volume of the relay-unit air-sending device is set to (0.784×ratio of R32+0.830×ratio of HFO1234yf)×m ($m^3$/min) or greater.

9. The air-conditioning apparatus of claim 1, wherein the refrigerant is propane and the ventilation volume of the relay-unit air-sending device is set to 6.3×m ($m^3$/min) or greater.

10. The air-conditioning apparatus of claim 1, wherein the refrigerant amount m (kg) in the heat medium relay unit is a maximum refrigerant amount allowed to exist in the heat medium relay unit on the basis of a refrigerant state according to an operation mode carried out by the heat medium circulating circuit.

11. The air-conditioning apparatus of claim 1, wherein the refrigerant amount m (kg) in the heat medium relay unit is a product of a total value ($m^3$) of internal volumes of refrigerant pipes and components in which the refrigerant passes in the heat medium relay unit, and a density (kg/$m^3$) of the refrigerant.

12. The air-conditioning apparatus of claim 1, wherein the refrigerant amount m (kg) in the heat medium relay unit is a product of a total value ($m^3$) of the internal volumes of refrigerant pipes and components in which the refrigerant passes in the heat medium relay unit, and 1000 (kg/$m^3$).

13. The air-conditioning apparatus of claim 1, wherein the heat medium flow switching devices are housed in the heat medium relay unit.

14. The air-conditioning apparatus of claim 1, wherein the heat medium circulating circuit includes a heat medium flow control device that is connected by pipes and that controls a flow rate of the heat medium caused to flow into and out of the use side heat exchanger, the heat medium flow control device being housed in the heat medium relay unit.

15. The air-conditioning apparatus of claim 1, wherein the outdoor unit and the heat medium relay unit are connected by two pipes, and the heat medium relay unit and each of the indoor units are connected by two pipes.

16. The air-conditioning apparatus of claim 1, wherein the heat medium relay unit is disposed in a space inside a structure in which ventilation to an outdoor space by natural convection or forced convection is allowed.

17. The air-conditioning apparatus of claim 1, wherein the controller is configured to set, in the control operation, a ventilation volume of the relay-unit air-sending device to between 0.55 to 6.3×m ($m^3$/min) with respect to the refrigerant amount m (kg) in the refrigerant circuit.

* * * * *